United States Patent [19]

Hoks

[11] 4,016,001

[45] Apr. 5, 1977

[54] METHOD AND DEVICE FOR OBTAINING SUGAR CRYSTALS FROM A SUGAR SOLUTION

[75] Inventors: Dirk Hoks, Hengelo, Netherlands;

[73] Assignee: Stork Werkspoor Sugar B.V., Henogelo; Suiker Uncie Holding B.V.; Rotterdam, both of Netherlands

[22] Filed: June 13, 1975

[21] Appl. No.: 586,658

[30] Foreign Application Priority Data

June 14, 1974 Netherlands ..... 7408016

[52] U.S. Cl. ..... 127/16; 127/60; 127/61; 159/17 R; 159/45; 159/47 R

[51] Int. Cl.[2] ..... C13F 1/00; C13F 1/02

[58] Field of Search ..... 127/16, 60, 61; 154/17 R, 45, 47 R

[56] References Cited

UNITED STATES PATENTS

| | | | |
|---|---|---|---|
| 2,115,029 | 4/1938 | Luque | 127/16 X |
| 3,503,803 | 3/1970 | Bennett | 127/16 |

OTHER PUBLICATIONS

"Cane Sugar Handbook," by George P. Meade, 9th Ed., pp. 132–174, John Wiley, (1963).

*Primary Examiner*—Joseph Scovronek
*Assistant Examiner*—Sidney Marantz
*Attorney, Agent, or Firm*—Snyder, Brown & Ramik

[57] ABSTRACT

A method and a device for obtaining sugar crystals from a sugar solution by concentrating the thick juice emanating from the multi-stage evaporator in a continuously operating pre-concentrator to a concentration at which seed granulate could be added to the boiling pan, by raising the pressure of the concentrated thick juice, by supplying the juice to a buffer vessel in which the juice is subjected to a higher pressure than the pressure at which it is concentrated, the temperature being maintained and the contents of the vessel being thoroughly stirred and by filling the boiling pan from the buffer vessel while simultaneously seed granulate is added.

20 Claims, 1 Drawing Figure

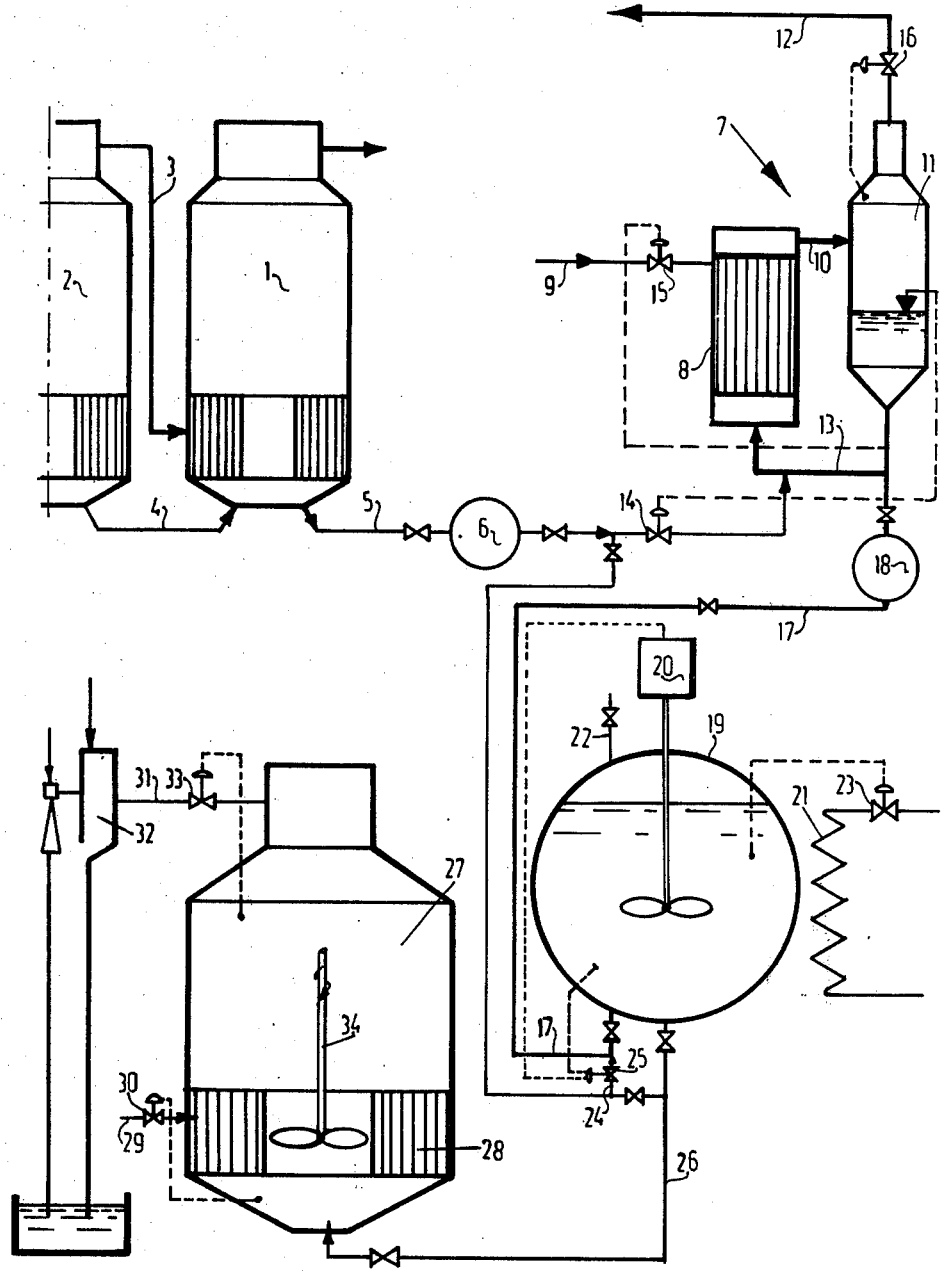
1
2
3
4
5
6
7
8
9
10
11
12
13
14
15
16
17
18
19
20
21
22
23
24
25
26
27
28
29
30
31
32
33
34

METHOD AND DEVICE FOR OBTAINING SUGAR CRYSTALS FROM A SUGAR SOLUTION

The invention relates to a method and a device for obtaining sugar crystals from a sugar solution by concentrating the solution in a multi-stage evaporator and by supplying the thick juice through a buffer vessel to a discontinuous boiling pan, in which the sugar is allowed to crystallize out. In the known method the juice emanating from the multi-stage evaporator in a concentration of about 65 Brix is concentrated in a boiling pan, in which the temperature of the thick juice is slightly higher than the value corresponding to the boiling temperature of the juice at the absolute pressure prevailing in the boiling pan. During the concentration self-evaporation will occur so that the concentration of the juice increases. When a given level of juice in the boiling pan is attained, the supply of heating vapour is opened so that the juice is further concentrated. When the juice is sufficiently concentrated, seed granulate is added so that crystallisation can start. During crystallization sub-saturated juice is added, while the supply of heat continues. When finally the concentration has reached the maximum value, the boiling cycle terminates and the boiling pan can be emptied.

The invention has for its object to provide a semi-continuous method in which considerable energy saving can be ensured and a number of additional advantages are obtained.

According to the invention the thick juice emanating from the multi-stage evaporator is concentrated in a continuously operating pre-concentrator to a concentration at which seed granulate can be added in the boiling pan, the pressure of the concentrated thick juice being increased and the juice being fed into a buffer vessel, in which the juice is subjected to a higher pressure than the pressure at which it is concentrated, the temperature being maintained and the contents of the vessel being thoroughly stirred, while the boiling pan is filled from the buffer vessel and seed granulate is added simultaneously. With such a method the first part of the boiling cycle, which has hitherto been carried out in a boiling pan, is performed in the pre-concentrator. In the pre-concentrator the working temperature and pressure correspond with those at which in the boiling pan the juice would be concentrated to the same concentration. The value of this concentration may be of the order of 85 Brix. Since the largest quantity of water is evaporated in the concentrator, the developed vapour is available for use elsewhere in the system, for example, for heating the boiling pan. This means an important saving of energy. With the known methods the boiling pan was heated by vapour from the first or second stage of the multi-stage evaporator. In accordance with the invention the heating steam can be derived from the concentrator, which can be heated by vapour from the second or third evaporation stage. A direct consequence of the method described is that less injection water is needed in the condensation devices.

Since only crystallisation rather than concentration takes place in the boiling pan, a much higher capacity can be attained with the same contents of the boiling pan. Moreover, the peak load of the steam withdrawal is also more favourable. An additional advantage is that a change-over from the known method to the method embodying the invention requires only small investment because a majority of the existing apparatus can be employed.

According to the invention it is advantageous to regulate the quantity of heating steam supplied to the pre-concentrator in dependence upon the temperature of the concentrated juice, the pressure of the inspissated juice being kept at a constant value, whilst the adjusted temperature and the pressure of the regulators are determined as state magnitudes associated with the thick juice of the desired concentration and the level in the concentrator is kept constant. With such a regulating system the correct values can be readily adjusted with any desired production concentration in accordance with the purity of the juice.

As stated above, the steam developed from the concentrator may be used elsewhere in the system.

The invention furthermore relates to a device for carrying out the method described above, said device comprising a multi-stage evaporator and a discontinuous boiling pan.

According to the invention the multi-stage evaporator has arranged after it a continuously operating pre-concentrator, whose juice outlet is connected with a buffer vessel, in which a higher pressure may prevail than in the pre-concentrator and which is provided with means capable of maintaining the temperature of the vessel. Since a higher pressure prevails in the buffer vessel than in the pre-concentrator, the over-saturated juice will not crystallize out provided the temperature of the vessel does not drop.

In accordance with the invention the pressure in the buffer vessel can be raised in a simple manner by establishing an open communication between the space above the fluid level and the environment. Then atmospheric pressure prevails in the buffer vessel, which materially exceeds the pressure in the pre-concentrator.

According to the invention a displacer pump may be included in the conduit between the pre-concentrator and the buffer vessel. It can thus be ensured in a simple manner that the pressure in the buffer vessel exceeds that in the concentrator.

In accordance with the invention the conduit between the last stage of the multi-stage evaporator and the pre-concentrator may include a displacer pump. This provides the advantage that fluctuations of the operational conditions of the pre-concentrator will not affect the multi-stage evaporator.

According to the invention the buffer vessel may be constructed in a spherical shape. This provides an advantageous ratio between the heat emitting surface and the contents of the buffer vessel. In this case a minimum amount of heat is required for maintaining the temperature of the vessel. Moreover, the vessel has no dead corners in which over-saturation could occur to an extent such that crystals would form spontaneously.

In accordance with the invention the buffer vessel may be provided with an agitator, whose driving gear is connected with a regulating device controlling the supply of sub-saturated juice to the buffer vessel, so that with an increase of the absorbed power of the driving gear beyond a given value sub-saturated juice is fed to the vessel. In this way a very effective protection against an undersirable increase in over-saturation is obtained. If the over-saturation increases and the concentration rises, the power absorbed by the driving gear will increase and as soon as a critical value is attained, the over-saturation can be eliminated by feeding sub-saturated juice.

In an effective embodiment the boiling pan may be provided with a mechanical agitator. In the novel method no heating steam need be supplied, when the juice is fed to the boiling pan. Hitherto steam has been constantly supplied in order to ensure adequate circulation. In order to ensure a satisfactory circulation in the novel method, even if no steam is supplied, it is important to provide a mechanical agitator. If such a stirring device were not employed, sub-saturated juice as well as heating steam could be supplied. Like hitherto a circulation would then be produced due to the heat produced by the supply of steam.

According to the invention the buffer vessel may be double-walled, while the chamber enclosed between the walls may be provided with one or more connecting stubs. The space can thus be exhausted so that a satisfactory thermal insulation is obtained. It is, as an alternative, possible to feed steam into the chamber between the walls so that heat losses to the outside can be completely compensated for.

The invention will be described more fully hereinafter with reference to the drawing and a process shown schematically. In the drawing the various apparatus forming part of the system embodying the invention are illustrated schematically.

Reference numeral 1 designates the last stage of a multi-stage evaporator. The penultimate stage thereof is designated by 2. The vapour evolving in the evaporator 2 is fed through the conduit 3 to the evaporator 1. The juice concentrated in the evaporator 2 is supplied through a conduit 4 to the evaporator 1, from where the juice flows through the conduit 5 and a displacer pump 6 to a pre-concentrator 7. The pre-concentrator comprises an evaporation body 8, to which steam is supplied via the conduit 9. On the top side the evaporator communicates through the conduit 10 with the vapour separator 11, from which the developed vapour can escape through the conduit 12, whereas through conduit 13 the fluid is supplied to the evaporation body 8. The vapour escaping through the conduit 12 may be utilized elsewhere in the system, for example, for heating boiling pans. The conduit 5 includes a regulator 14, which keeps the level in the separator 11 constant. The conduit 9 includes a regulator 15, which controls the steam supply in accordance with the temperature in the conduit 13. The conduit 12 includes a regulator 16, which maintains the pressure prevailing in the separator 11. With the conduit 13 communicates a conduit 17, which includes a displacer pump 18. Through the conduit 17 the juice inspissated in the pre-concentrator 7 is fed to a buffer vessel 19. The buffer vessel has a spherical shape and is provided with a mechanical agitator 20. There is furthermore provided a heating element 21. Through a conduit 22 the vessel can communicate with the open air. With the aid of the heating element 21 the contents of the vessel are maintained at the desired temperature, the steam being supplied to the heating element 21 through a regulator 23, which responds to the temperature in the vessel. The conduit 17 communicates with a conduit 24 including a regulator 25. The regulator 25 is controlled by the power absorbed by the agitator 20, which means that at an increase in the absorbed power beyond a given value the regulator 25 feeds juice of lower concentration than the juice already contained in the vessel 19 from the conduit 5 to the vessel. Moreover, the regulator 25 is acted upon by a direct measurement of the concentration of the contents of the vessel 19. Consequently, the regulator 25 ensures that the concentration in the vessel 19 will not rise to a value at which crystallisation could occur. Through a conduit 26 the vessel 19 communicates with a boiling pan 27. The boiling pan 27 is provided with a heating element 28, to which steam is supplied through a conduit 29. The conduit 29 includes a regulator 30, which responds to over-saturation of the juice in the boiling vessel. The vapour developed in the boiling pan 27 is conducted away through a conduit 31, which communicates with a condensation device 32. The conduit 31 includes a regulator 33, which maintains the vacuum in the boiling pan. The boiling pan 27 is furthermore provided with a mechanical agitator 34.

The device operates as follows. Through the displacer pump 6 and the conduit 5 the juice concentrated, for example, to a concentration of 65 Brix is fed from the multi-stage evaporator to the pre-concentrator 7. In this pre-concentrator the juice is thickened to a concentration of, for example, 85 Brix. The thickened juice is fed from the concentrator through the conduit 17 and the displacer pump 18 to the buffer vessel 19. In the buffer vessel 19 prevails a higher pressure than in the pre-concentrator 7, so that evaporation will no longer occur and the concentration will, therefore, not increase further. In order to avoid condensation the heat loss is compensated for by the heating element 21. The uniform temperature is maintained by means of the agitator 20, which serves in addition as a further safeguard gainst crystallisation. If the concentration should nevertheless increase, the power absorbed by the agitator 20 would rise to a very high value so that the regulator 25 would feed juice of 65 Brix from the conduit 5 to the buffer vessel. The concentration would then drop immediately. At the beginning of a boiling cycle the juice of 85 Brix stored in the buffer vessel is fed to the boiling pan 27, whilst smultaneously seed granulate is added. Only a small quantity of water need be evaporated in the boiling pan 27 in order to initiate crystallisation. The major quantity of water to be evaporated in order to raise the concentration from 65 to 85 Brix is evaporated in the pre-concentrator, the developed vapour being conducted away through the conduit 12 for utilization at a further place. As compared with the prior-art methods an important saving of energy is thus obtained. Moreover, the capacity of the available boiling pans can be raised because the cycle in the boiling pan can be much shorter. Because a considerably smaller quantity of vapour is required for the condensation device 32, the consumption of cooling water of the condensation device is materially reduced.

I claim:

1. In a method of obtaining sugar crystals from a sugar solution which comprises the steps of concentrating the sugar solution to a predetermined value by multi-stage evaporation and subsequently obtaining the sugar crystals in a boiling pan into which seed crystals are introduced, the improvement which comprises the steps of:

a. substantially continuously passing the concentrated sugar solution obtained from multi-stage evaporation to a preconcentrator, applying heat to the sugar solution in the preconcentrator while maintaining the pressure therein below atmospheric pressure by withdrawing steam from the preconcentrator, the heat being applied in amount sufficient to increase the concentration of the sugar solution in the preconcentrator to a value at which seed crystals can be added thereto in the boiling pan;

b. continuously passing the sugar solution from the preconcentrator to a holding vessel until a selected quantity of sugar solution has accumulated therein, maintaining the pressure within the holding vessel at a higher value than the value maintained in said preconcentrator while maintaining the temperature of the sugar solution substantially constant in the holding vessel, and continuously stirring the sugar solution in the holding vessel; and c. batchwise discharging said selected quantity of sugar solution in the holding vessel into the boiling pan while simultaneously adding seed crystals thereto, applying heat to the boiling pan while maintaining the pressure therein less than atmospheric pressure and lower than that value maintained in the holding vessel by withdrawing steam from the boiling pan.

2. In a method as defined in claim 1 wherein (b) includes the steps of monitoring the power required to effect the continuous stirring of the sugar solution and introducing sugar solution from multi-stage evaporation into the holding vessel when such power reaches a predetermined value.

3. In a method as defined in claim 2 wherein (c) includes the step of continuously stirring the sugar solution within and as it is discharged into said boiling pan.

4. In a method as defined in claim 1 wherein the sugar solution obtained by multi-stage evaporation is in the order of 65 Brix and wherein the sugar solution as passed to the holding vessel is in the order of 85 Brix.

5. In a method as defined in claim 4 wherein (b) includes passing the sugar solution from the preconcentrator to the holding vessel by means of a positive displacement pump whereby the holding vessel is pressure-isolated from the preconcentrator.

6. In a method as defined in claim 5 wherein the pressure maintained in said holding vessel is atmospheric.

7. In a method as defined in claim 6 wherein (a) includes passing the sugar solution from the multi-stage evaporator to the preconcentrator by means of a positive displacement pump whereby the preconcentrator is pressure-isolated from the multi-stage evaporator.

8. In a method as defined in claim 1 wherein (a) includes the steps of maintaining a fixed level of sugar solution in the preconcentrator and maintaining a fixed pressure in the preconcentrator.

9. In a method as defined in claim 8 wherein the sugar solution obtained by multi-stage evaporation is in the order of 65 Brix and wherein the sugar solution as passed to the holding vessel is in the order of 85 Brix.

10. In a method as defined in claim 9 wherein (b) includes passing the sugar solution from the preconcentrator to the holding vessel by means of a positive displacement pump whereby the holding vessel is pressure-isolated from the preconcentrator.

11. In a method as defined in claim 10 wherein the pressure maintained in said holding vessel is atmospheric.

12. In a method as defined in claim 11 wherein (a) includes passing the sugar solution from the multi-stage evaporator to the preconcentrator by means of a positive displacement pump whereby the preconcentrator is pressure-isolated from the multi-stage evaporator.

13. In a system for obtaining sugar crystal from a sugar solution which includes a multi-stage evaporator and a boiling pan, the improvement which comprises:

a preconcentrator including supply means connecting said preconcentrator to a last stage of the multi-stage evaporator for supplying sugar solution of predetermined concentration to the preconcentrator, means for supplying heat to the preconcentrator and means for withdrawing steam from the sugar solution in the preconcentrator at a rate sufficient to maintain the pressure within the preconcentrator at less than atmospheric pressure whereby the concentration of the sugar solution within the preconcentrator is increased to a value at which seed crystals could be added to such solution if it were directly introduced into said boiling pan;

a holding vessel and supply means connecting said preconcentrator to the holding vessel for feeding sugar solution to said holding vessel, conduit means connnecting said holding vessel to the boling pan and including normally closed valve means for allowing sugar solution to accumulate in said holding vessel whereafter it is delivered batchwise to the boiling pan, agitating means for continuously stirring the contents of said holding vessel, means for maintaining a pressure within said holding vessel sufficiently higher than that in said preconcentrator as to prevent further concentration of said sugar solution in the holding vessel; and said boiling pan including means for withdrawing steam therefrom at a rate sufficient to maintain the pressure in the boiling pan lower than atmospheric pressure and lower than that in said holding vessel, condenser means for condensing the steam issuing from said boiling pan, and means for supplying heat to said boiler pan.

14. In a system as defined in claim 13 wherein the sugar solution supplied from the multi-stage evaporator is about 65 Brix and the sugar solution supplied to the holding vessel is about 85 Brix.

15. In a system as defined in claim 13 including means for maintaining a constant level of sugar solution in the preconcentrator.

16. In a system as defined in claim 15 wherein the pressure maintained in said holding vessel is atmospheric pressure, the steam withdrawn from the preconcentrator being connected to the means for supplying heat to the boiling pan.

17. In a system as defined in claim 13 wherein said holding vessel is spherical.

18. In a system as defined in claim 17 wherein said agitating means includes a drive motor, supplementary conduit means connecting said supply means between the multi-stage evaporator and the preconcentrator to the holding vessel and including control valve means for selectively bleeding sugar solution from the multi-stage evaporator into the holding vessel, and control means sensing the power consumed by said drive motor for actuating said control valve means in response to power consumption greater than a predetermined value.

19. In a system as defined in claim 18 wherein the supply means connecting the preconcentrator to the holding vessel includes a positive displacement pump.

20. In a system as defined in claim 19 wherein the supply means connecting the multi-stage evaporator to the preconcentrator includes a positive displacement pump.

* * * * *